US010223874B2

(12) United States Patent
Whiteaker

(10) Patent No.: US 10,223,874 B2
(45) Date of Patent: Mar. 5, 2019

(54) AUTOMATED TELLER MACHINE ARMOR SYSTEM

(71) Applicant: Greg Alan Whiteaker, Cheyenne, WY (US)

(72) Inventor: Greg Alan Whiteaker, Cheyenne, WY (US)

( * ) Notice: Subject to any disclaimer, the term of this patent is extended or adjusted under 35 U.S.C. 154(b) by 0 days.

(21) Appl. No.: 15/783,465

(22) Filed: Oct. 13, 2017

(65) Prior Publication Data

US 2018/0053383 A1 Feb. 22, 2018

(51) Int. Cl.
*E05G 1/024* (2006.01)
*G07F 19/00* (2006.01)

(52) U.S. Cl.
CPC ..... *G07F 19/205* (2013.01); *E05G 1/024* (2013.01)

(58) Field of Classification Search
CPC ..... E05G 1/024; G07F 19/205
USPC ..... 109/22–85
See application file for complete search history.

(56) References Cited

U.S. PATENT DOCUMENTS 3,190,041 A * 6/1965 Kimball ..... F16M 7/00 248/637
4,559,881 A * 12/1985 Lankard ..... B28B 23/00 106/644
6,896,181 B2 * 5/2005 Utz ..... G06Q 20/1085 235/379
6,971,322 B2 * 12/2005 DuBois ..... G07F 9/10 109/24.1
D580,125 S * 11/2008 Osiecki ..... D99/43
8,714,446 B2 5/2014 Graef et al.
9,127,495 B2 9/2015 Romero et al.
9,582,972 B2 2/2017 Tavares De Pinho
9,683,401 B2 6/2017 Smith
2010/0170424 A1 * 7/2010 Pinho ..... G07F 19/20 109/50
2012/0186086 A1 * 7/2012 Tavares De Pinho ..... E05G 1/024 29/897.34

(Continued)

FOREIGN PATENT DOCUMENTS

GB 2486199 A * 6/2012 ..... E05G 1/024
GB 2478534 1/2015

OTHER PUBLICATIONS

Hyosung Halo II 2600 Product Data Sheet, 2 pages, published 2015 by Nautilus Hyosung.

(Continued)

*Primary Examiner* — Suzanne L Barrett
(74) *Attorney, Agent, or Firm* — Thomas J. Lavan

(57) ABSTRACT

A system is provided. The system includes one or more of a jacket including a plurality of armor panels. The jacket includes a base panel, a back side, a rear panel, extending upwards from the base panel, including first and second opposed vertical sides and a bottom side, the rear panel bottom side orthogonally secured to the back side of the base panel, and first and second side panels, extending upwards from the base panel a predetermined distance. The first side panel includes a front edge that is adjacent to one or more vault door hinges of a vault door. The second side panel includes a front edge that is adjacent to an opening side of the vault door and configured to vertically cover a seam between the vault door and a chassis of the automated teller machine when the vault door is closed.

20 Claims, 14 Drawing Sheets

*Automated Teller Machine Positioning in Jacket*

(56) References Cited

U.S. PATENT DOCUMENTS

| | | | | |
|---|---|---|---|---|
| 2012/0222590 | A1* | 9/2012 | Marques | E05G 1/024 109/78 |
| 2012/0234215 | A1* | 9/2012 | Tamura | G07D 11/00 109/80 |
| 2013/0233211 | A1* | 9/2013 | Tavares de Pinho | E05G 1/024 109/51 |
| 2014/0048594 | A1* | 2/2014 | Kovacs | G07D 11/0063 235/379 |
| 2014/0096709 | A1* | 4/2014 | McGunn | G07D 11/0009 109/52 |
| 2015/0356834 | A1* | 12/2015 | Smith | G07F 19/205 109/24 |

OTHER PUBLICATIONS

Hyosung 2700 Product Data Sheet, 2 pages, published 2013 by Nautilus Hyosung.

* cited by examiner

*Fig. 1 Automated Teller Machine Exterior Components*
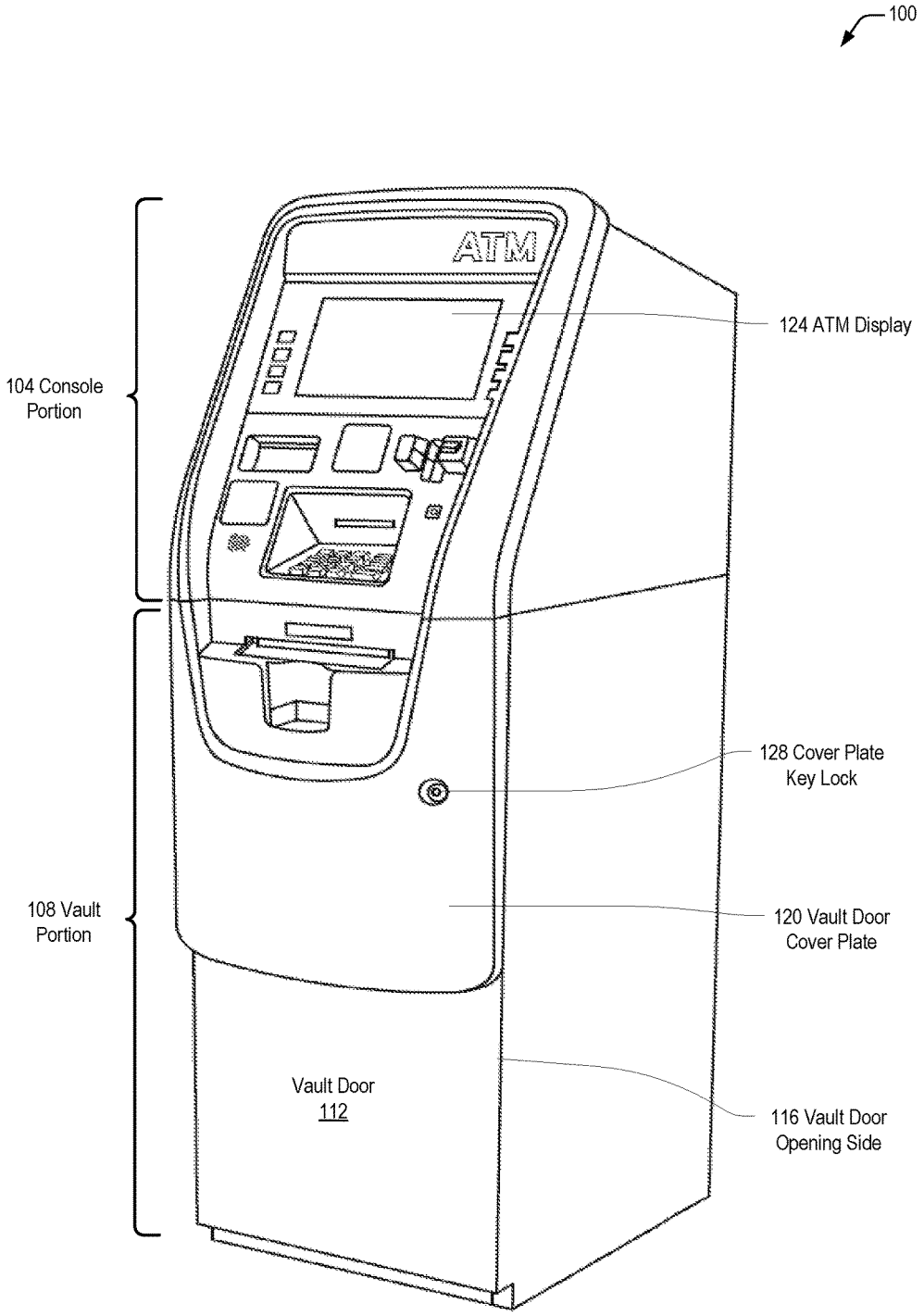

*Fig. 2 Automated Teller Machine Positioning in Jacket*
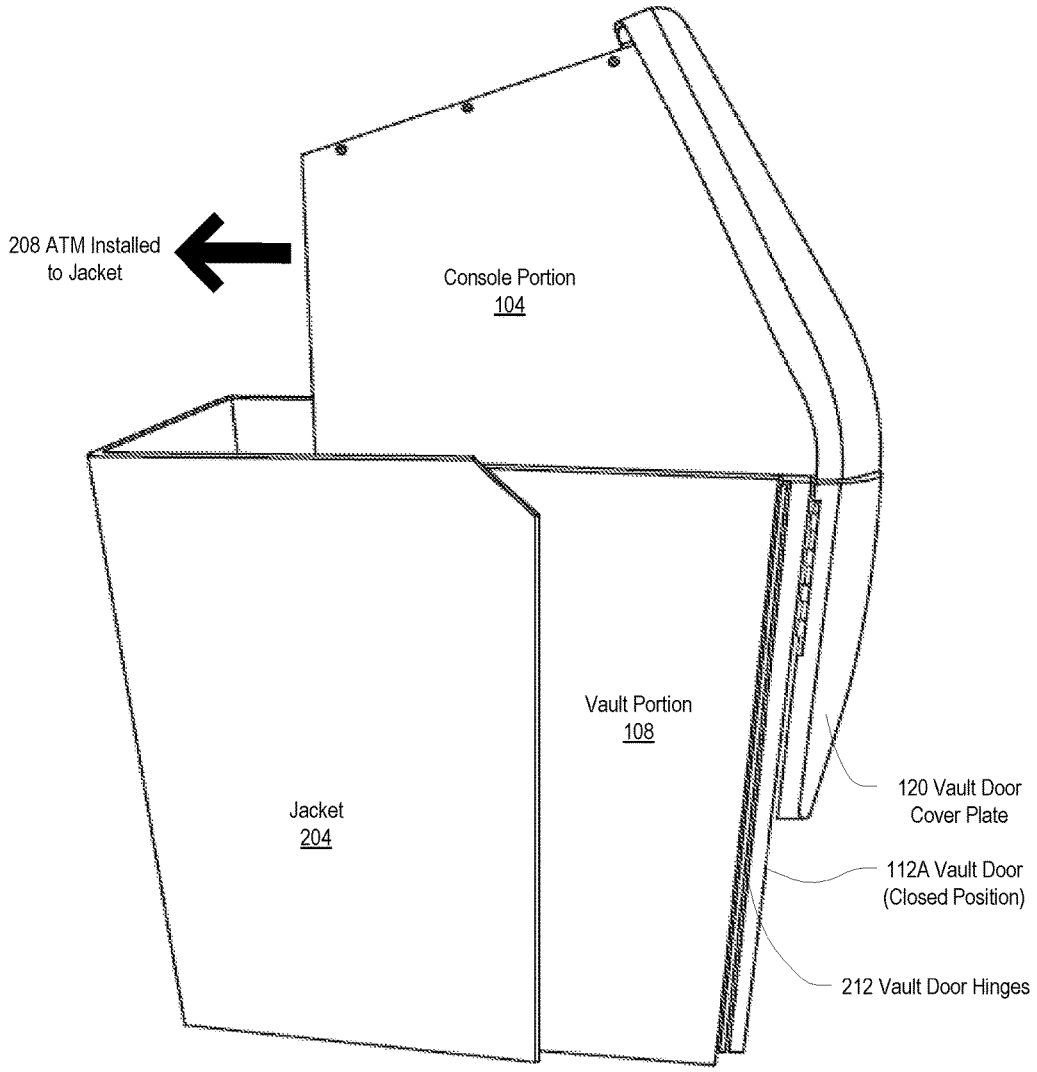

*Fig. 3 Vault Location Within Automated Teller Machine*
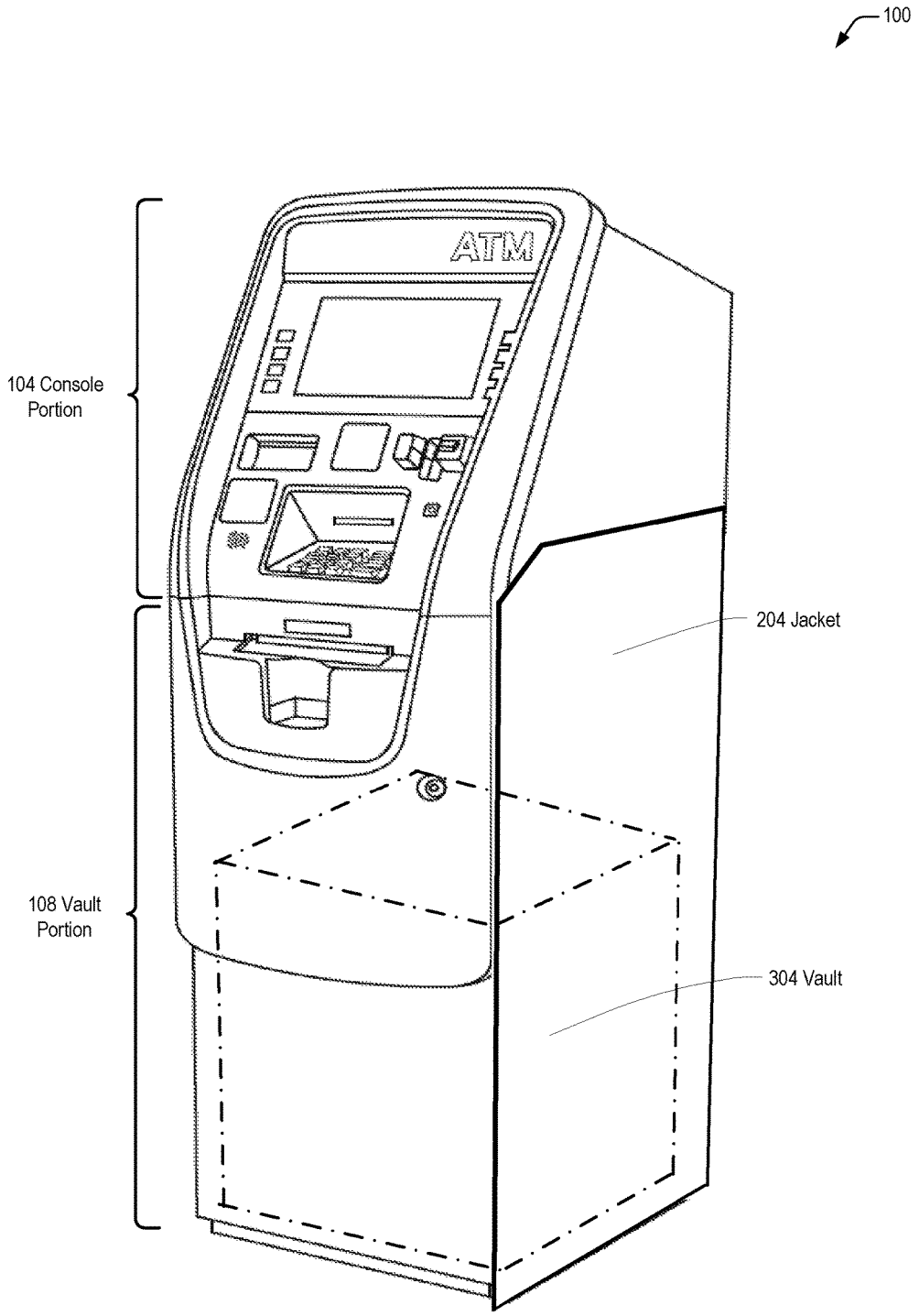

*Fig. 4 Jacket Armor Panels*
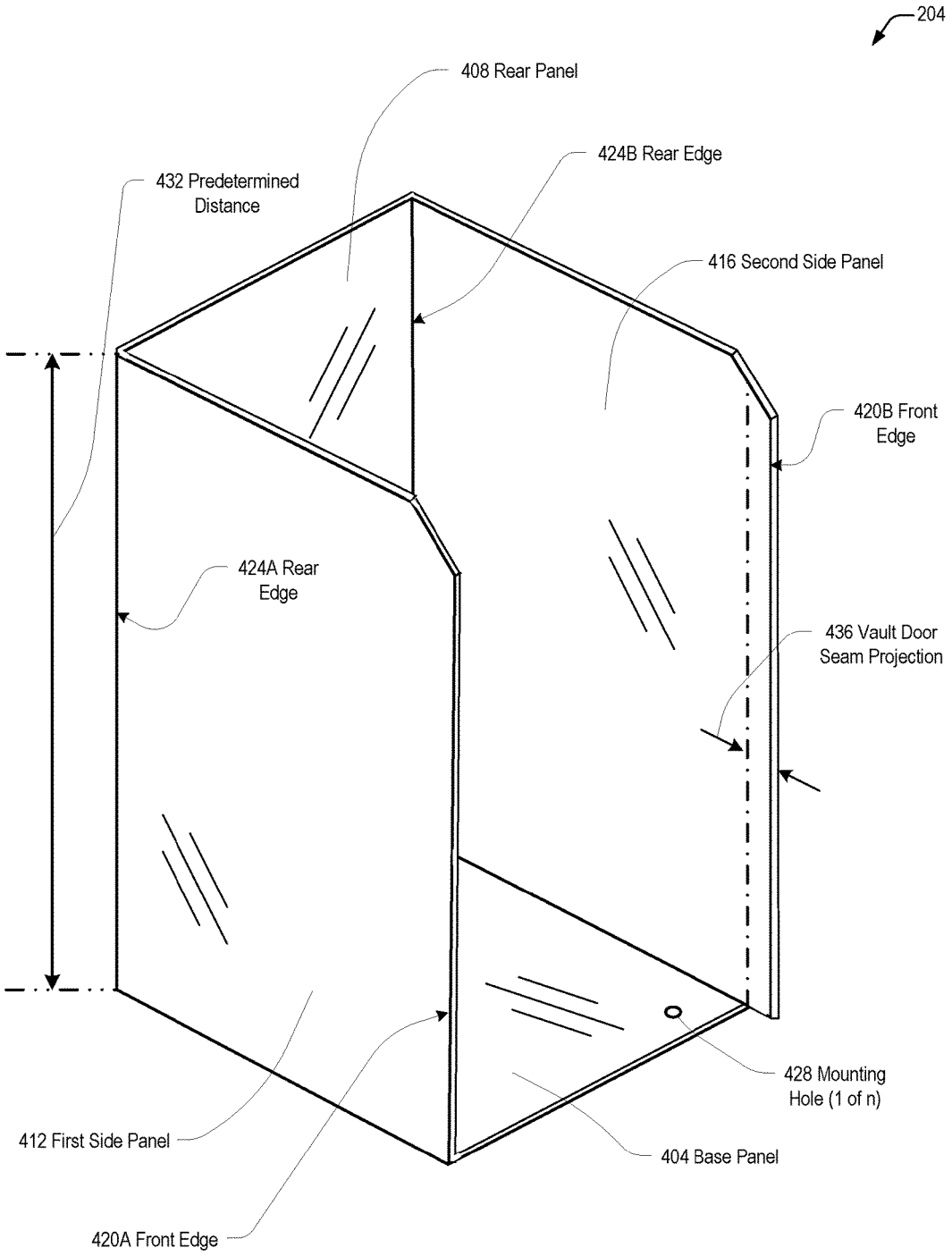

*Fig. 5 Jacket First Isometric Rear View*
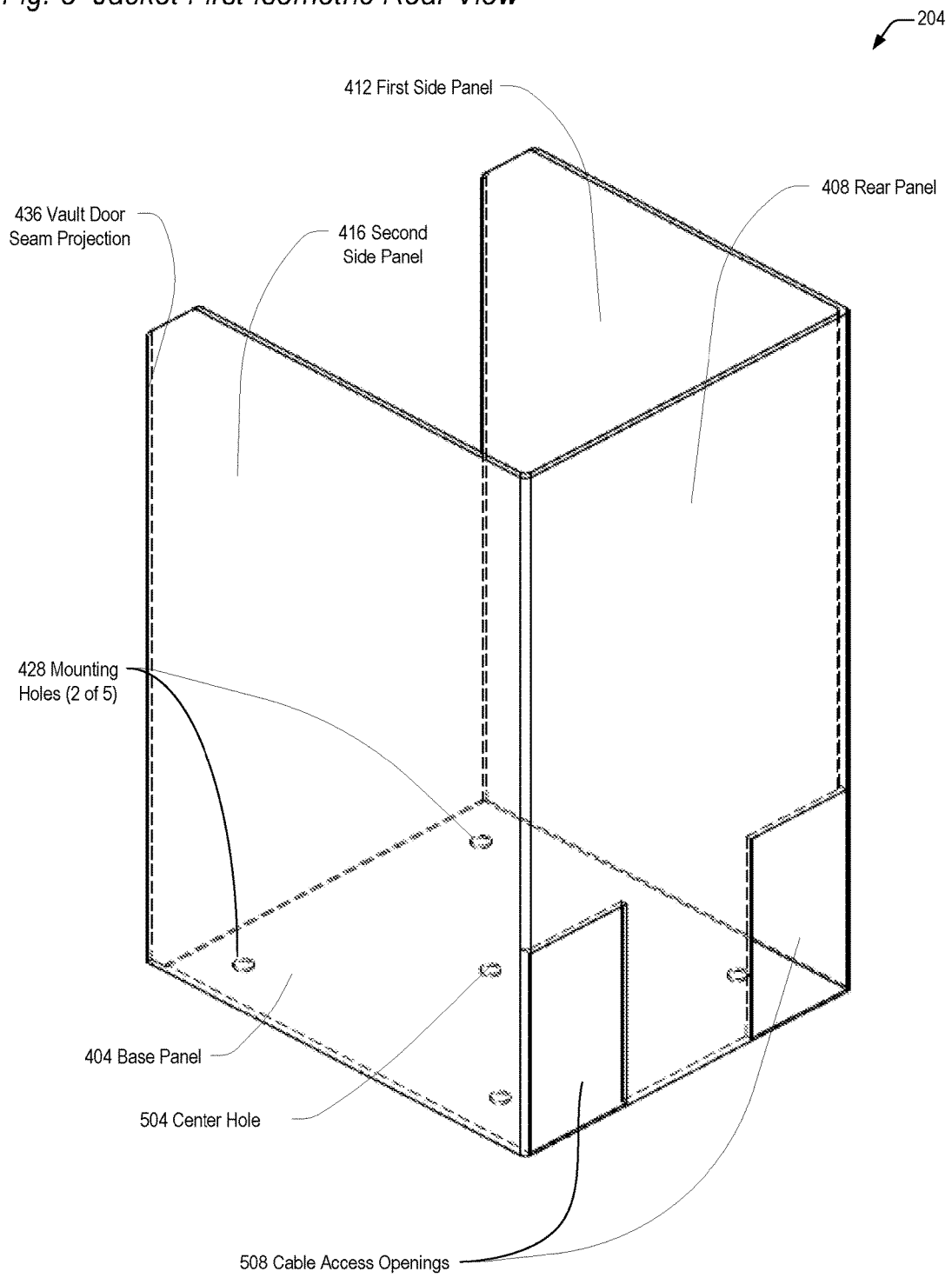

*Fig. 6 Jacket Second Isometric Rear View*
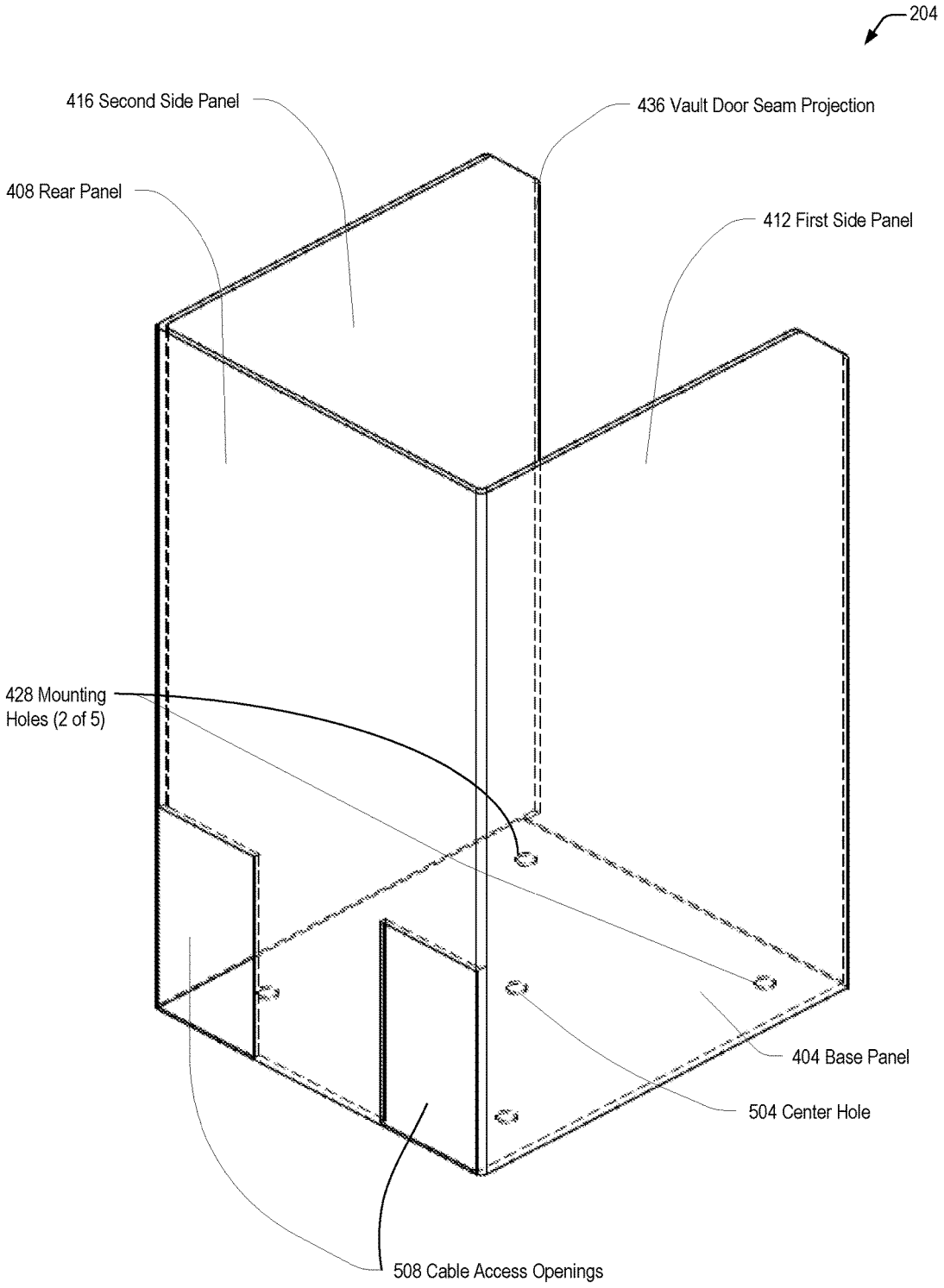

*Fig. 7 Installed Door and Bottom Armor Panels*
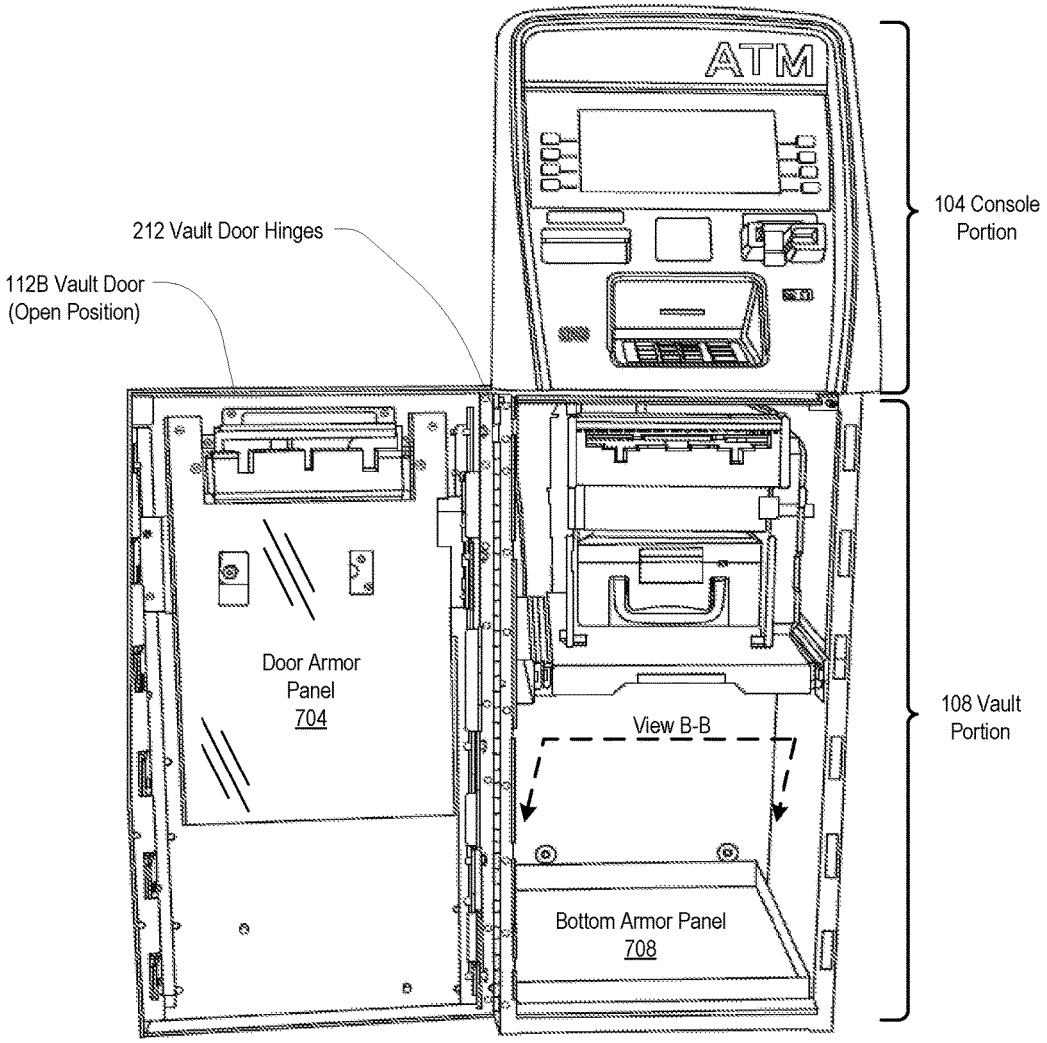

*Fig. 8 Installed Door Armor Panel*
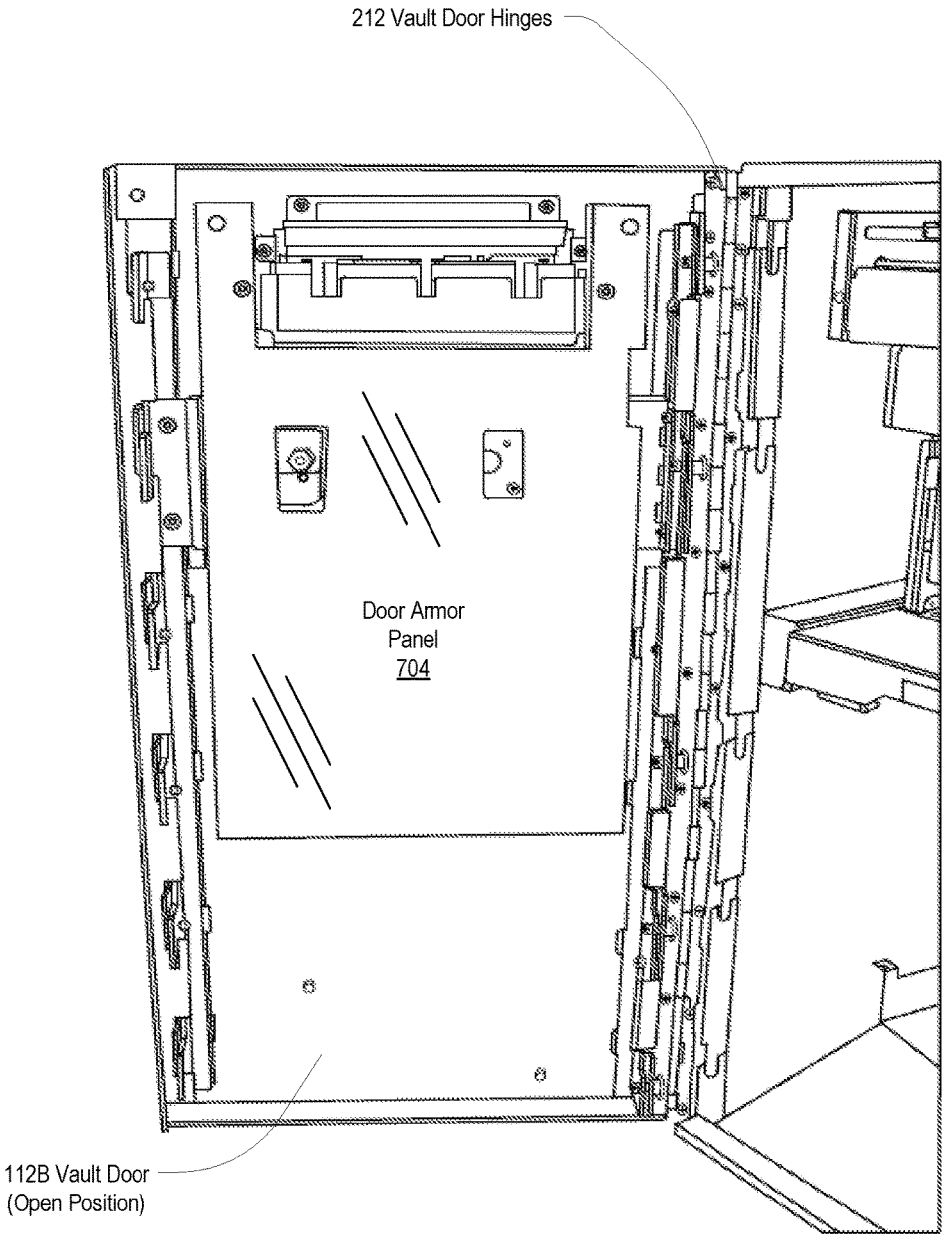

*Fig. 9A Door Armor Panel*
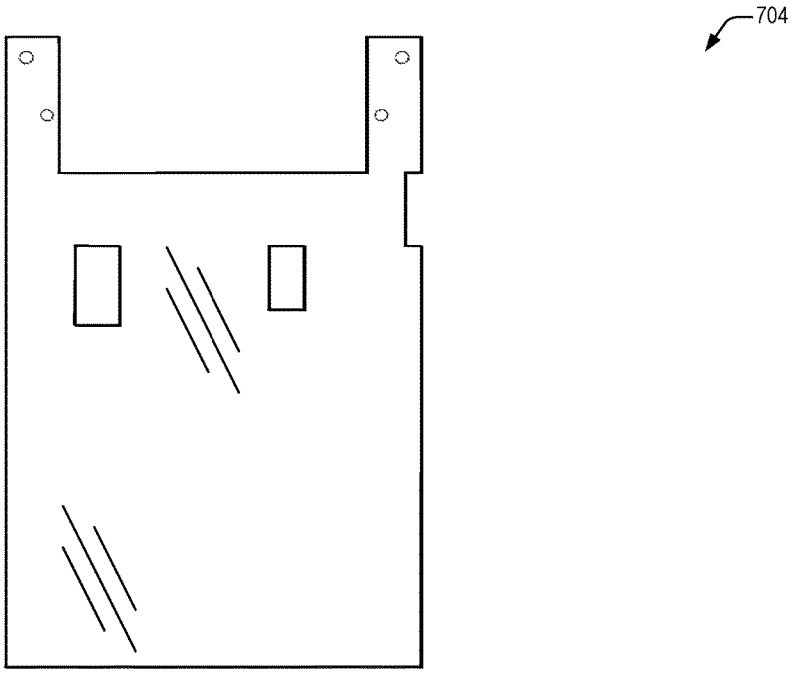
*Fig. 9B Door Armor Panel*
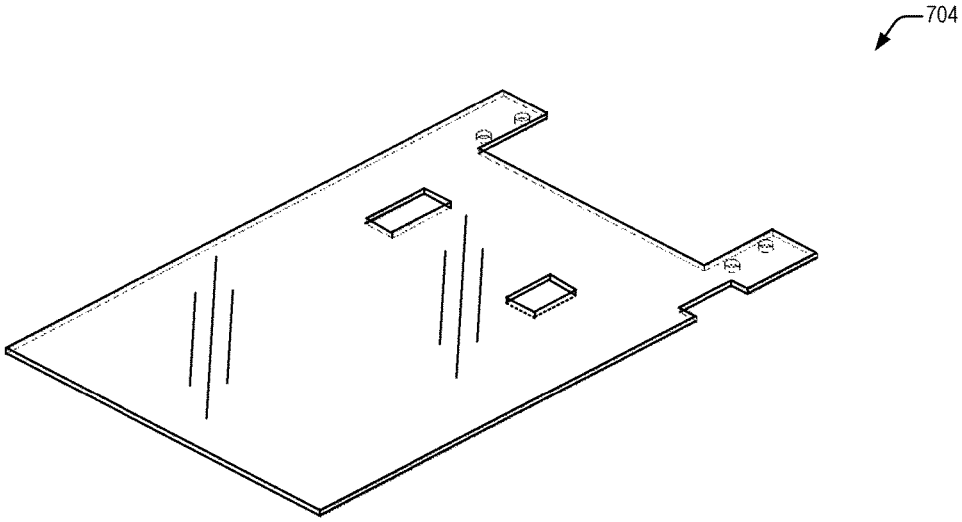

*Fig. 10 Automated Teller Machine with Extended Console*
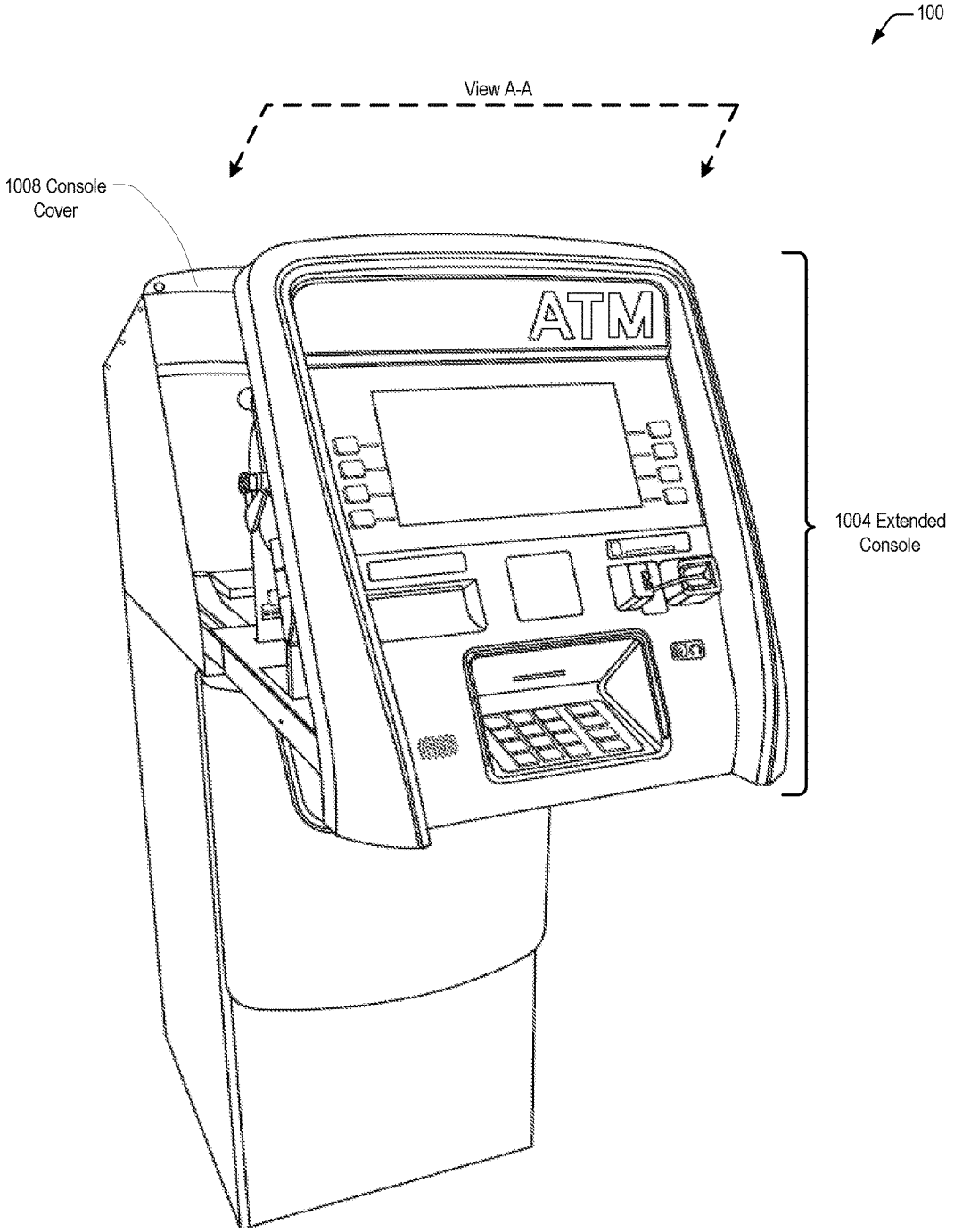

*Fig. 11 Top Armor Panel View A-A*
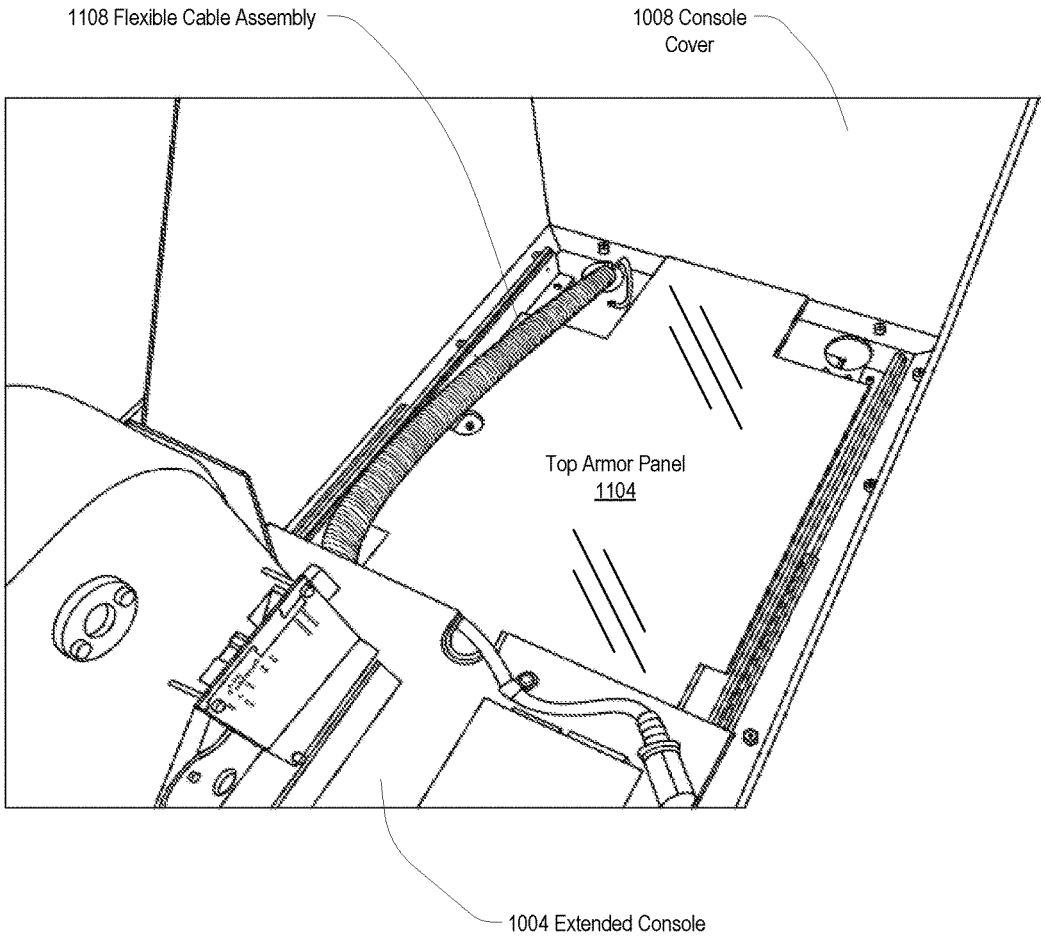

*Fig. 12A Top Armor Panel*
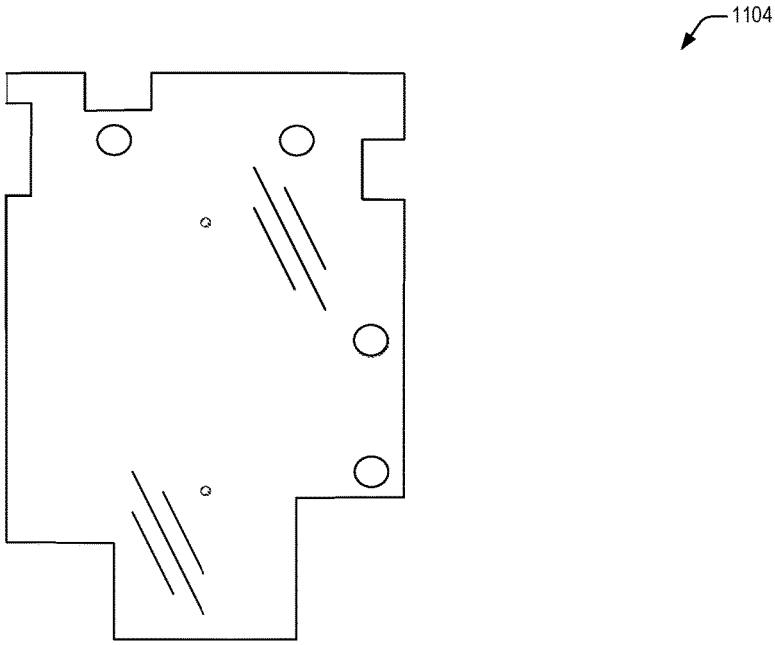
*Fig. 12B Top Armor Panel*
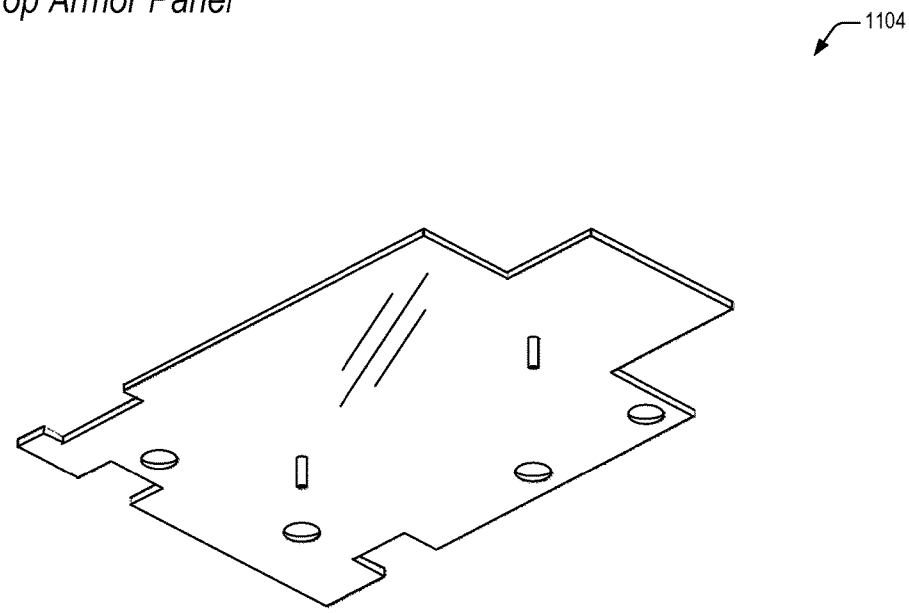

*Fig. 13 Installed Bottom Armor Panel View B-B*
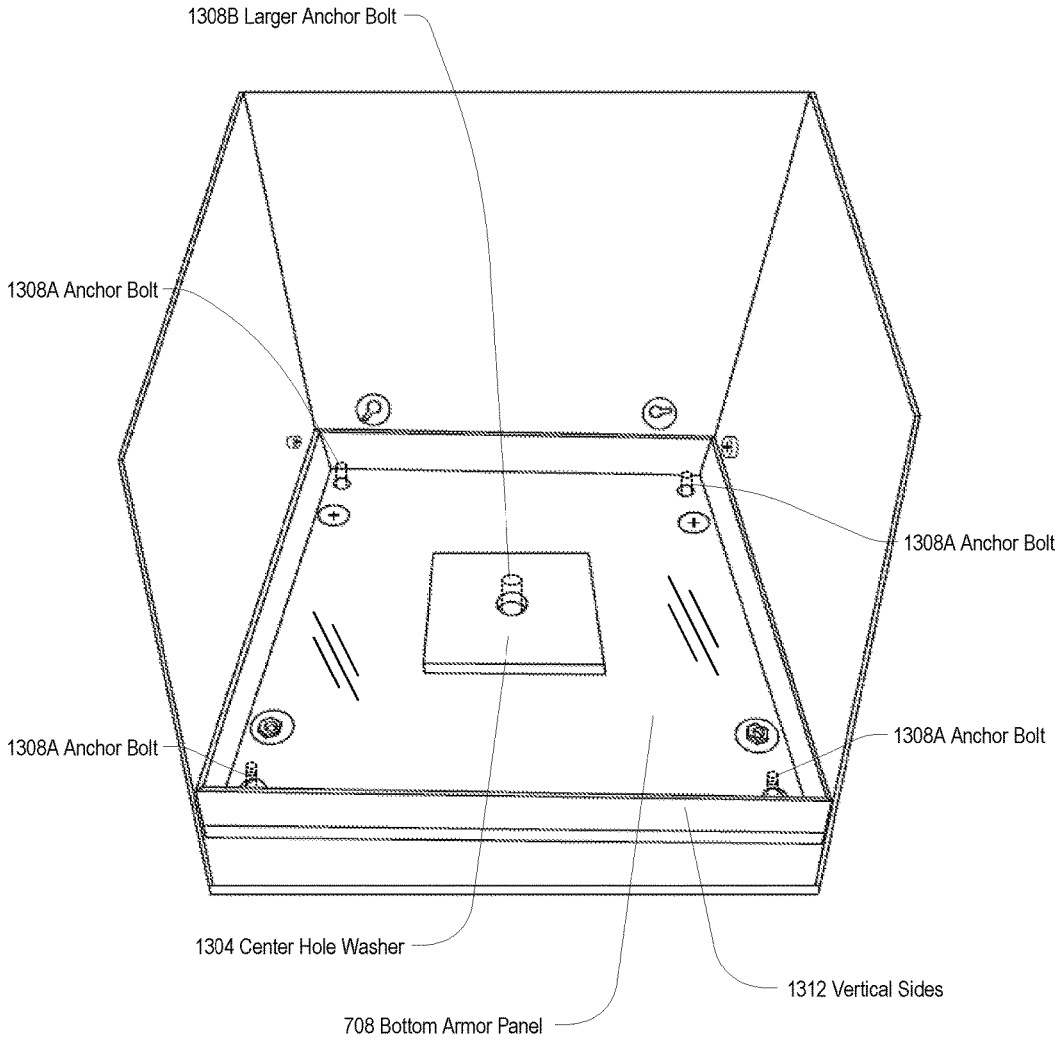

*Fig. 14A Bottom Armor Panel*
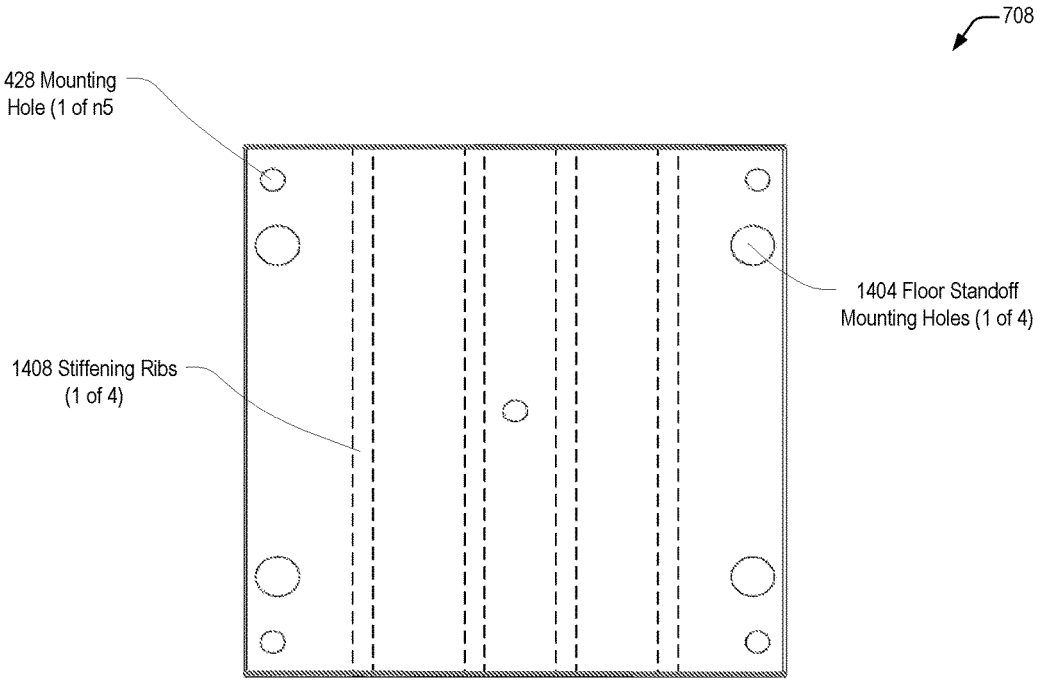
*Fig. 14B Bottom Armor Panel*
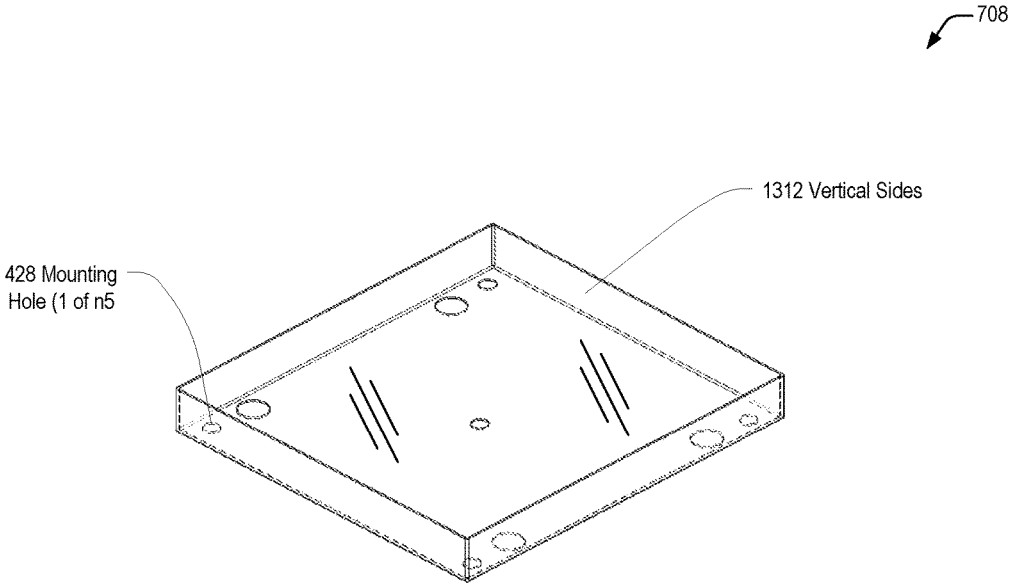

AUTOMATED TELLER MACHINE ARMOR SYSTEM

FIELD

The present invention is directed to systems for armoring automated teller machines to resist theft and tampering.

BACKGROUND

Manufacturers of automated teller machines (ATMs) market their equipment typically in two market segments: financial markets and retail markets. The ATMs that are installed in the financial markets are targeted at larger and higher volume financial institutions, and the ATMs installed in the retail markets are targeted at lower volume and more plentiful retail market locations. The retail market entails most all locations that can use an ATM that are not part of banks or financial institutions. The retail market has much lower transaction volume on average than the financial market so a lower cost enhanced security solution is needed in the retail market than in the financial market.

Retail market ATMs tend to be less expensive to buy, transport, and install than financial market ATMs, and one reason is that retail market ATMs tend to use lighter weight and less secure vaults than their financial market counterparts. A typical retail market ATM might weigh approximately 225 lbs., while it is not uncommon to find financial market ATMs weighing approximately 1200 lbs. In addition to retail market ATM purchase price being much lower than financial market ATM purchase price, with their lighter weight, they take much less manpower to move and install, leading to a lower cost to transport and install than financial market ATMs. A typical retail market ATM is typically able to be moved and installed by one person, whereas financial market ATMs commonly require more than one person to move or install, due to the additional weight. This adds to the cost to move and install financial market ATMs as compared to retail market ATMs. Because of their lower total investment, retail market ATMs require much less transaction volume to become profitable and financially sustainable than their financial market counterparts, which is why financial market ATMs are not typically used in the retail market segment. With their cheaper and less secure vaults and more plentiful locations, retail market ATMs are often prime targets for theft.

There are many more lower volume ATM locations than higher volume ATM locations, which is why retail market ATMs make up the majority of all ATM installations. It would not be possible to use the more expensive and more secure financial market ATMs in the retail market segment, since the transaction volume in the retail segment would not be sufficient to sustain the ATM investments in these lower volume locations. The transaction volume in the retail segment is only enough to financially sustain financially the lower cost retail ATMs. Substituting financial ATMs that have better, higher rated, and more secure vaults in the retail market is not a feasible solution to increasing the security of retail market ATM vaults.

There are various rating systems for vaults that measure a degree of difficulty in breaching the vault. One rating system is put out by Underwriters Laboratories (UL) and is commonly used to rate ATM vault security. A typical financial ATM might have a minimum rating of "UL 291" "level 1" safe and other more expensive models might have higher or different ratings than UL291 level 1, including RAL TL-30 derivatives, and CEN EN 1143-1-CEN III and CEN IV. It is typical for retail market ATMs to have a UL291 "business hour" rating only, a step lower than a "level 1" rating. With a business hour rating, it is recommended to only leave cash in the vault during normal business hours. However, even with such a rating, it is only feasible for very few ATM operators to remove the cash at all times when the business is closed. This leads to a situation where most ATMs with only UL 291 business hour rating stay stocked with cash at all times, even during the times the locations are physically closed and not open for business. This in turn leads to the problem in large numbers of retail ATMs being the cash in the ATM vault only protected by business hour rated safes after hours.

Most ATMs are connected to interbank networks, enabling people to withdraw and deposit money from machines not belonging to the bank where they have their accounts or in the countries where their accounts are held (enabling cash withdrawals in local currency). ATMs rely on authorization of a financial transaction by a card issuer or other authorizing institution on a communications network. Many banks charge ATM usage fees. In some cases, these fees are charged solely to users who are not customers of the bank where the ATM is installed; in other cases, they apply to all users. ATMs are placed not only near or inside the premises of banks, but also in locations such as shopping centers/malls, airports, grocery stores, convenience stores, petrol/gas stations, restaurants, or anywhere frequented by large numbers of people.

There are two types of ATM installations: on- and off-premises. On-premises ATMs are typically more advanced, multi-function machines that complement a bank branch's capabilities, and are thus more expensive (financial market ATMs). Off-premises machines are deployed by financial institutions and independent sellers (Retail market ATMs). ATMs can also be found in railway stations and train stations, and bus terminals.

An ATM is typically made up of the following devices: a CPU to control the user interface and transaction devices, a magnetic or chip card reader to identify customers, a PIN pad, a secure crypto-processor, generally within a secure enclosure, a display for customers to perform transactions, function key buttons or a touchscreen to select options for the transaction, a record printer to provide customers with transaction records, a vault to store the parts of the machinery requiring restricted access, including cash, a housing for aesthetics and to attach signage to, and various sensors and indicators.

Mechanisms found inside the vault may include: a dispensing mechanism to provide cash to customers, a deposit mechanism including a check processing module and bulk note acceptor to allow customers to make deposits, various security sensors, locks to ensure controlled access to the contents of the vault, and journaling systems.

Early ATM security focused on making the terminals invulnerable to physical attack; they were effectively safes with dispenser mechanisms. A number of attacks resulted, with thieves attempting to steal entire machines by ram-raiding or "smash and grab" attacks. Since the late 1990s, criminal groups improved ram-raiding by using a truck loaded with heavy items to effectively demolish or uproot an entire ATM and any housing in order to steal its cash.

Another attack method is to seal all openings of the ATM with silicone and fill the vault with a combustible gas or to place an explosive inside, attached, or near the machine. This gas or explosive is ignited and the vault is opened or distorted by the force of the resulting explosion and the thieves can then break in. These types of attacks can be prevented by a number of gas explosion prevention devices also known as gas suppression systems. These systems use explosive gas detection sensor to detect explosive gas and to neutralize it by releasing a special explosion suppression chemical which changes the composition of the explosive gas and thereby renders it ineffective.

SUMMARY

The present invention is directed to solving disadvantages of the prior art. In accordance with embodiments of the present invention, a system is provided. The system includes one or more of a jacket including a plurality of armor panels. The jacket includes a base panel of rectangular disposition, including first and second opposed sides, a back side, and a first plurality of holes configured to allow an automated teller machine including a vault to be secured to a floor by anchor bolts secured to the floor through the first plurality of holes, a rear panel, extending upwards from the base panel, including first and second opposed vertical sides and a bottom panel. The rear panel bottom side being orthogonally secured to the back side of the base panel, and first and second side panels extend upwards from the base panel a predetermined distance. The first side panel includes a bottom edge orthogonally secured to the first side of the base panel, a rear edge orthogonally secured to the first vertical side of the rear panel, and a front edge that, when the jacket is installed to the automated teller machine, is adjacent to one or more vault door hinges of a vault door of the automated teller machine and configured to allow the vault door to swing between open and closed positions, the vault door configured to be in the closed position when locked and the open position when the vault is being accessed. The second side panel includes a bottom edge orthogonally secured to the second side of the base panel, a rear edge orthogonally secured to the second vertical side of the rear panel, and a front edge that, when the jacket is installed to the automated teller machine, is adjacent to an opening side of the vault door and configured to vertically cover a seam between the vault door and a chassis of the automated teller machine when the vault door is closed.

In accordance with another embodiment of the present invention, a system is provided. The system includes an automated teller machine, which includes one or more of a console portion, disposed within a top portion of the automated teller machine and a vault portion, disposed within a bottom portion of the automated teller machine. The vault portion includes a vault, configured to store cash, which includes a vault door, disposed on a front surface of the vault and configured to be in a closed position when locked and an open position when the vault is being accessed and one or more vault door hinges disposed between a front side of the vault and a side of the vault door, configured to allow the vault door to swing between the open and closed positions. The system also includes a jacket including a plurality of armor panels, configured to cover bottom, side, and rear surfaces of the vault portion. The jacket includes a base panel of rectangular disposition, including first and second opposed sides, a back side, and a first plurality of holes through which anchor bolts secure the automated teller machine to a floor beneath the jacket, the anchor bolts and associated washers and nuts providing the only fastening devices between the jacket and the automated teller machine. The jacket also includes a rear panel, extending upwards from the base panel a predetermined distance, including first and second opposed vertical sides and a bottom side, the rear panel bottom side orthogonally secured to the back side of the base panel, the predetermined distance extending to a height greater than a top level of the vault. The jacket also includes a first side panel, extending upwards from the base panel the predetermined distance, which includes a bottom edge orthogonally secured to the first side of the base panel, a rear edge orthogonally secured to the first vertical side of the rear panel, and a front edge adjacent to the one or more vault door hinges and configured to allow the vault door to swing between open and closed positions, the vault door configured to be in the closed position when locked and the open position when the vault is being accessed. The jacket further includes a second side panel, extending upwards from the base panel the predetermined distance, which includes a bottom edge orthogonally secured to the second side of the base panel, a rear edge orthogonally secured to the second vertical side of the rear panel, and a front edge that, when the jacket is installed to the automated teller machine, is adjacent to an opening side of the vault door and configured to cover a vertical seam between the vault door and a chassis of the automated teller machine when the vault door is closed.

One advantage of the present invention is that it provides a system to protect contents of an automated teller machine vault without requiring equivalent protection for less-valuable components of an automated teller machine. The less-valuable components of an automated teller machine include electronics, displays, communication components, and cash dispensing components. Additionally, the less-valuable contents of an automated teller machine (i.e., the components of the automated teller machine itself) may be covered by an insurance policy specific to the automated teller machine and therefore not require similar protection as the contents of the vault.

Another advantage of the present invention is that it provides significant protection for the most valuable components of an automated teller machine (i.e. within the vault) while preserving an attractive aesthetic appearance of the automated teller machine. The front of the automated teller machine as an unaltered appearance, while the jacket armor protects the side, rear, and bottom of the automated teller machine. Internal top armor panel, door armor panel, and bottom armor panel components are out of sight of customers and therefore do not contribute to a feeling that the automated teller machine may be located in a high crime area. Other automated teller machine armor solutions may encompass the entire automated teller machine structure in imposing and thick armor panels and fasteners, resulting in an intimidating appearance.

Another advantage of the present invention is that it requires only minimal modification of an automated teller machine to install all the components. Depending on the model of the automated teller machine, the only armor panel that may require modification of the automated teller machine is the bottom armor panel, which ideally requires a fifth center anchor bolt and fasteners in addition to the standard four anchor bolts and fasteners at the bottom corners of the automated teller machine. The fifth center anchor bolt provides significant additional strength to the automated teller machine when mounted to an underlying floor, making "smash and grab" attacks less likely to be successful.

Yet another advantage of the present invention is it provides significant protection for an automated teller machine vault while allowing components to be shippable within a 150 pound envelope. This, in turn, reduces the cost of security components by allowing more cost-effective commercial freight carriers to deliver components instead of a specialized freight carrier or the armor panel manufacturer.

Additional features and advantages of embodiments of the present invention will become more readily apparent from the following description, particularly when taken together with the accompanying drawings. This overview is provided to introduce a selection of concepts in a simplified form that are further described below in the detailed description. It may be understood that this overview is not intended to identify key features or essential features of the claimed subject matter, nor is it intended to be used to limit the scope of the claimed subject matter.

BRIEF DESCRIPTION OF THE DRAWINGS

FIG. 1 is a diagram illustrating exterior components of an exemplary automated teller machine in accordance with embodiments of the present invention.

FIG. 2 is a diagram illustrating automated teller machine positioning within a jacket in accordance with embodiments of the present invention.

FIG. 3 is a diagram illustrating a vault location within an automated teller machine in accordance with embodiments of the present invention.

FIG. 4 is a diagram illustrating jacket armor panels in accordance with embodiments of the present invention.

FIG. 5 is a diagram illustrating a jacket first isometric rear view in accordance with embodiments of the present invention.

FIG. 6 is a diagram illustrating a jacket second isometric rear view in accordance with embodiments of the present invention.

FIG. 7 is a diagram illustrating installed door and bottom armor panels in accordance with embodiments of the present invention.

FIG. 8 is a diagram illustrating an installed door armor panel in accordance with embodiments of the present invention.

FIG. 9A is a diagram illustrating a plan view of a door armor panel in accordance with embodiments of the present invention.

FIG. 9B is a diagram illustrating an isometric view of a door armor panel in accordance with embodiments of the present invention.

FIG. 10 is a diagram illustrating an automated teller machine with an extended console in accordance with embodiments of the present invention.

FIG. 11 is a diagram illustrating a view A-A of an installed top armor panel in accordance with embodiments of the present invention.

FIG. 12A is a diagram illustrating a plan view of a top armor panel in accordance with embodiments of the present invention.

FIG. 12B is a diagram illustrating an isometric view of a top armor panel in accordance with embodiments of the present invention.

FIG. 13 is a diagram illustrating a view B-B of an installed bottom armor panel in accordance with embodiments of the present invention.

FIG. 14A is a diagram illustrating a plan view of a bottom armor panel in accordance with embodiments of the present invention.

FIG. 14B is a diagram illustrating an isometric view of a bottom armor panel in accordance with embodiments of the present invention.

DETAILED DESCRIPTION

The present invention provides the ability to increase the security level of vaults within ATMs without the need to purchase very expensive financial market ATMs for ATM operators operating in the lower volume retail ATM market. The present invention can be also be used to increase the security levels of already higher rated financial ATM vaults. The present invention allows ATM owners and operators to have the option of increasing vault security in higher risk locations. In addition, with the relatively light weight of the invention described herein, its security enhancement can be applied with the same level of installation resources as with the lighter retail market ATM itself, thus making the expense of installation much lower than when installing the heavier financial market ATMs. The present application allows for a financially feasible higher security solution without the need to buy higher cost financial, and many times financially unfeasible financial market ATMs. It additionally allows the flexibility for the armor investment to be moved from ATM to ATM and from location to location, such as the ATM operator determines to be feasible. The present application allows the installation and removal of the invention without damaging the ATM, so the ATM can be used later as it normally would in a lower risk location without the security improvement if the operator so chooses with not residual damage to display.

The present application alleviates the need for a second lock on the vault door, in contrast to other known solutions that require a second lock. A second lock adds more time to access a vault, thus increasing the chance of a breach in security as the ATM is loaded.

In addition, unlike the higher rated financial market ATM vaults, the present application discloses an exterior ATM appearance that serves as an outer visual deterrent to a prospective thief, while providing an attractive appearance to ATM customers. When a prospective thief views the additional protection the present application provides, it lowers the chance of the thief targeting the ATM attack. The present application provides these benefits by not adversely affecting the aesthetics of the ATM. The front, top, and upper sides of the ATM are not modified and the ATM maintains most of the original attractive appearance designed by the manufacturer. This represents a novel benefit of the present application as compared to other alternatives and is important in locations where aesthetics are important.

The present application describes various forms of physical protection for automated teller machines in the form of pre-fabricated armor panels. Although the Figures specifically illustrate a Hyosung model NH2600SE automated teller machine for exemplary purposes, the present application is not limited to this model or manufacturer, and the features, installation, and operation of the armor components described herein may be adopted to any model of automated teller machine.

Referring now to FIG. 1, a diagram illustrating exterior components of an exemplary automated teller machine 100 in accordance with embodiments of the present invention is shown. Automated teller machines 100 generally include two major components: a console portion 104, and a vault portion 108. The console portion 104 includes various components to interact with customers to perform financial transactions, including one or more displays 124, a keyboard, function keys, a card reader, and illumination source for nighttime use, and a printer for printing transaction receipts. The console portion 104 may include other components as well, such as one or more computers, cameras, power supplies, communication transceivers, sensors, and various indicators. Additionally, control components within the console portion 104 provide various control signals and feedback signals to control distribution of cash to customers through various actuated mechanisms between the vault and exterior of the vault portion 108.

The vault portion 108 includes the vault 304 as well as several exterior features related to aspects of the present application. The vault portion 108 includes a vault door cover plate 120, which is generally a light-duty aesthetic plastic or metal hinged cover that hides the ATM vault combination lock and other controls to access the interior of the vault 304. In some embodiments, the vault door cover plate 120 has an associated cover plate keylock 128, which is a light-duty lock intended to secure the vault door cover plate 120 when the vault 304 is not being accessed. The vault portion 108 also includes a vault door 112, which is generally hinged on one of two sides and allows access to the vault 304 itself. In some embodiments, the vault door 112 includes an exterior plastic or light-duty metal panel that is painted to match other surfaces on the exterior of the automated teller machine 100, as well as a heavier-duty metal panel to provide limited security to the front of the vault itself. The vault door 112 generally has a hinged side (on the left in the illustrated embodiment) and a vault door opening side 116 opposite to the hinged side. While the vault door 112 itself may be vulnerable to various forms of direct attack from the front, the vertical seam at the opening side of the vault door 116 are a common vulnerable attack location to various forms of prying attack, such as with a crowbar.

In most embodiments, the automated teller machine 100 is secured to a floor through anchor bolts in the bottom of the automated teller machine 100. The anchor bolts are intended to prevent the entire automated teller machine 100 from simply being carried away, where the vault 304 may then be broken into at a different location. In most embodiments, there are four anchor bolts—one at each bottom corner-securing the automated teller machine 100 to the floor.

Referring now to FIG. 2, a diagram illustrating automated teller machine 100 positioning within a jacket 204 in accordance with embodiments of the present invention is shown. The present application describes an automated teller machine protection system including both exterior and interior components. The exterior component is an armored jacket 204 that protects the vault 304 and/or vault portion 108. The automated teller machine 100 is installed to the jacket 204 by sliding or placing the automated teller machine 100 into the jacket 208 from front to back. The jacket 204 protects the side, rear, and bottom of the automated teller machine 100 from various forms of drilling, prying, or cutting.

The jacket 204, when the automated teller machine 100 is installed in the jacket 208, extends forward to just before vault door hinges 212. This allows the vault door 112 to open fully while the automated teller machine 100 is installed to the jacket 208. FIG. 2 illustrates the vault door in a closed position 112A.

Referring now to FIG. 3, a diagram illustrating an exemplary vault 304 location within an automated teller machine 100 in accordance with embodiments of the present invention is shown. The vault 304 stores cash and in some embodiments other forms of currency or valuables. The vault 304 itself may or may not be armored, and depends on security of the vault door 112 to protect access to the vault 304. In most embodiments, the vault 304 is installed in the bottom area of the vault portion 108. However, the vault 304 in other embodiments may be installed anywhere within an automated teller machine 100, and the present application is not limited to the vault 304 being installed in any specific area.

Referring now to FIG. 4, a diagram illustrating jacket 204 armor panels in accordance with embodiments of the present invention is shown. The jacket 204 may be formed in one of three ways: as a welded assembly of four different panels, as a bent single armor plate, or as a combination of welded/bent armor plates where some joints are welded in other joints are a bend between orthogonal plates. Each panel of a welded assembly may be constructed from different materials or thicknesses, or the same material or thicknesses. However, bent armor plates would logically be constructed from this same material and thickness. Welded armor plates have the advantage of providing greater protection where more vulnerability exists and less protection where less vulnerability exists, but the disadvantage of potentially longer fabrication time due to the welding operations. Bent armor plates have the advantage of potentially less-vulnerable joints at the intersections of the various armor panels, but the disadvantage of requiring more elaborate fabrication equipment to make the required bends with close tolerances to the exterior surfaces of the automated teller machine 100. In the preferred embodiment, the jacket 204 is a welded structure utilizing different thicknesses of armor panels as described herein. For optimal protection, the welds between orthogonal panels extend along the continuous length of the mated armor panels (i.e. not spot welds or welds with the gaps between weld sections.

In the preferred embodiment, the jacket 204 fits as close to the side surfaces of the automated teller machine 100 as possible, without actually touching the sides. This should allow the automated teller machine 100 to slide into the jacket without scratching or damaging the sides of the automated teller machine 100. For improved installation safety and aesthetics, the edges of the jacket 204 are preferably beveled and deburred.

The jacket 204 includes a base panel 404, a rear panel 408, a first side panel 412, and a second side panel 416. The first side panel 412 is always opposite the second side panel 416; however the first side panel 412 may be located on either the left or right side of the automated teller machine 100. The first side panel 412 has a front edge 420A and a rear edge 424A, and is joined to the base panel 404 at a bottom edge. The second side panel 416 has a front edge 420B and a rear edge 424B, and is joined to the base panel 404 at a bottom edge. The base panel 404 includes mounting holes 428 to mount the automated teller machine 100 through the jacket 204 to a floor through anchor bolts or similar fasteners. In some embodiments, there are four mounting holes 428 in the base panel 404, corresponding to hole and anchor bolt locations of an installed automated teller machine 100. In the preferred embodiment, there are five mounting holes 428 in the base panel 404, including the standard four anchor bolt locations and also including a center fifth anchor bolt location as described herein. In one embodiment, mounting holes 428 may be sized to correspond to ½ inch anchor bolts 1308A. This has been found to be a common size for automated teller machine 100 anchor bolts, and in such cases advantageously does not require drilling larger holes in the bottom of the automated teller machine 100.

The first side panel 412 is not identical to the second side panel 416, since the first side panel 412 is located adjacent to the hinged side of the vault door 212 and the second side panel 416 is located adjacent to the opening side of the vault door 116. The first side panel 412 is limited in the distance it extends forward by the vault door hinges 212, and must allow the vault door 112 to open fully. The second side panel 416 extends further forward than the first side panel 412 in order to cover the seam between the opening side of the vault door 116 and the side of the vault portion 108. This limits the ability to pry the vault door 112 open from the opening side 116 by preventing a prybar or crowbar from being jammed into the seam. The distance by which the second side panel 416 extends forward of the base panel 404 and first side panel 412 is the vault door seam projection 436. In the preferred embodiment, the vault door seam projection 436 is approximately ¾ inch.

The jacket 204 extends upward from the base panel 404 a predetermined distance 432. The predetermined distance 432 must at least extend upward to a top surface of the vault 304 in order to provide full side/rear protection for the vault 304. In some embodiments, the jacket 204 extends vertically to cover a seam between the console portion 104 and the vault portion 108 of the automated teller machine 100. This has the advantage of limiting various forms of prying are cutting attacks at the joint where the console portion 100 meets the vault portion 108. An example of this is shown in FIG. 3, where the jacket 204 covers the seam shown in FIG. 1. In the preferred embodiment, the predetermined distance 432 is between the height of the vault 304 and just above the seam between the console portion 104 and the vault portion 108. Preferably, the predetermined distance 432 should also be at least an inch above the top surface of the vault 304.

It is not desirable to have the height of any of the panels of the jacket 204 extend to the top of the automated teller machine 100 or significantly above the seam between the console portion 104 and the vault portion 108. First, there is little value in providing armor over the console portion 104 since cash or other valuables are stored in the vault 304, which is in the vault portion 108 rather than the console portion 104. Second, additional armor over the console portion 104 adds significant weight to the jacket 204 and may prevent or inhibit low-cost commercial freight shipping or installation. Third, the additional armor over the console portion 108 will be more noticeable than the jacket 204 as described herein since customer eyes will be drawn to displays and controls on the console portion 108 and areas surrounding the console portion 108. This may have an aesthetic disadvantage of alarming customers that the automated teller machine 100 may be located in a high crime area and discourage further access to the automated teller machine 100.

All armor panels shown and described herein, including armor panels of the jacket 204, door armor panels 704, bottom armor panels 708, in top armor panel 1104 may be fabricated from all types of plate steel, stainless steel, and abrasion-resistant (AR) plate steel. In the preferred embodiment, armor panels of the present application are fabricated from A36 plate steel. A36 plate steel represents a good compromise between physical protection, weight, and cost. Although stainless steel may be appropriate to use for the door armor panel 704, it may not be a good choice for the other armor panels described herein. A good, although more expensive, alternative is abrasion-resistant (AR) plate steel. Unlike A36 plate steel, AR plate can only be cut with a plasma cutter instead of a blade or cutting torch, and therefore is more difficult to breach than A36 plate steel. Different armor panels of the present application may possibly be fabricated from different materials, depending on trade-offs between cost, protection, and weight.

Referring now to FIG. 5, a diagram illustrating a jacket 204 first isometric rear view in accordance with embodiments of the present invention is shown. The first isometric rear view illustrates the vault door seam projection 436, which extends forward from a front edge of the base panel 404 and the first side panel 412 to cover a seam between the vault door 112 and the side of the automated teller machine 100. Automated teller machines 100 require external connections to receive power and communicate with banks or other financial institutions. Cable access openings 508 are provided in appropriate locations on the rear panel 408 to provide access power and network cables. Although the cable access openings 508 are shown in the bottom corners of the rear panel 408, in other embodiments the cable access openings 508 may be positioned differently, or no cable access openings 508 may be required in the rear panel 408. In the latter case, power or network cables may connect to the automated teller machine 100 in other ways, including directly to the console portion 104 or through the base panel 404. FIG. 5 also shows mounting holes 428, where five mounting holes 428 are present including a center hole 504 to more securely couple the automated teller machine 100 and jacket 204 to a floor.

Referring now to FIG. 6, a diagram illustrating a jacket 204 second isometric rear view in accordance with embodiments of the present invention is shown. FIG. 6 provides a complementary view of the jacket 204 to the view shown in FIG. 5. Although the second side panel 416 is shown on the left side of the jacket 204 (as shown from the rear), the second side panel 416 could in other embodiments instead be configured on the right side of the jacket 204. The other embodiments and features described with respect to FIG. 5 apply to FIG. 6 as well.

In the preferred embodiment, the jacket 204 is fabricated from A36 plate steel, using a ⅛ inch base panel 404, ¼ inch side 412, 416 panels, and a 3⁄16 inch rear 408 panel. For installations where the automated teller machine 100 backs to a wall, the rear panel 408 may be fabricated from thinner plate than the side 412, 416 panels since the rear panel 408 may be more difficult to access and break through. This provides an advantage for welded fabrication techniques, where different thickness armor panels may be used for the jacket 204.

In the preferred embodiment, the weight of the jacket 204 is below 150 pounds, which is the maximum package weight limit imposed by some commercial freight carriers, including Federal Express (Fedex). It is desirable to fit within commercial freight carrier shipping requirements in order to reduce shipping costs and not require more expensive specialized shipping methods and carriers. It should be noted that many automated teller machines 100 weigh approximately 250 pounds, which may require a pallet and pallet jack to move.

In other embodiments, especially where AR plate is used, each of the side 412, 416 and rear 408 panels may be 3⁄16 inch thickness in order to further reduce weight. However, it has been found that using 3⁄16 inch A36 armor plate for the side panels 412, 416 is not recommended as it decreases the rigidity of the jacket 204 to various prying attacks. The base panel 404, being of thinner material than the side 412, 416 and rear 408 panels, still provides significant protection especially when combined with the various protections of the bottom armor panel 708 described herein. Notably, even if the bottom armor panel 708 itself is not used, the combination of a center anchor bolt 1308A/B with a center hole washer 1304 provides significant strength and protection to an installed automated teller machine 100. Other materials such as Aluminum or Titanium may be used. However, Aluminum is likely to provide insufficient protection while Titanium may be prohibitively expensive.

Preferably, all armor panels and especially the jacket 204 are painted in an attractive color that blends well with other colors used on the exterior of the automated teller machine 100. For example, various forms of black or medium-dark gray/brown powder coat finishes tend to enhance the appearance of the automated teller machine 100 without drawing undo attention to the jacket 204 or other security features of the automated teller machine 100. Although the jacket 204 in shape, size, and finish provides an attractive enhancement to an installed automated teller machine 100 without unduly alarming customers, the jacket 204 would likely be noticed by would-be thieves and discourage an attack. In some embodiments, one or more exterior surfaces of the jacket 204 or other armor panels of the present application may display an identifying logo or manufacturer identification.

Referring now to FIG. 7, a diagram illustrating installed door 704 and bottom 708 armor panels in accordance with embodiments of the present invention is shown. In most automated teller machines 100, a vault plate key lock 128 is unlocked in order to open a vault door cover plate 120. This then allows access to a vault door combination lock (not shown) or other form of secure vault door 112 lock. Once the vault door combination lock is unlocked, the vault door 112 may be swung open by vault door hinges 212 to a vault door open position 112B, as shown in FIG. 7. FIG. 7 illustrates a representative view of a vault portion 108 with a vault door opened 112B and the vault 304 removed, in order to provide a more clear view of a bottom armor panel 708 position and installation within the vault portion 108.

The door armor panel 704 is attached to an inside surface of the vault door 112 in order to provide additional protection to the vault 304 through the vault door 112. The door armor panel 704 is not intended to provide protection to the vault 304 when the vault door 112 is opened through normal use of the vault door combination lock, and the vault 304 is easily accessed when the vault door 112 is in an open position 112B. The door armor panel 704 in most embodiments is attached to the inside of the vault door 112 through normal fasteners and mounting hardware already included on the inside of the vault door 112. In some embodiments, it may be necessary to drill additional holes and provide additional mounting hardware to mount the door armor panel 704 to the inside surface of the vault door 112.

The bottom armor panel 708 is installed at the base of the vault portion 108, and the vault 304 is positioned within and above the bottom armor panel 708. The bottom armor panel 708 arrangement and installation is shown in more detail with respect to FIG. 13, and view B-B as shown in FIG. 7 illustrates the perspective from which FIG. 13 appears.

Referring now to FIG. 8, a diagram illustrating an installed door armor panel in accordance with embodiments of the present invention is shown. FIG. 8 illustrates installation of the door armor panel 704 slightly greater detail than FIG. 7. It should be noted that the door armor panel 704 may be installed with different mounting hardware and locations then shown in FIG. 8, in different mounting holes and arrangements may be required then shown herein.

Referring now to FIG. 9A, a diagram illustrating a plan view of a door armor panel 704 in accordance with embodiments of the present invention is shown. Door armor panel 704 is preferably fabricated from a single plate of uniform thickness, but in some embodiments may be constructed from multiple plates of varying dimensions, thicknesses, or materials. Door armor panel 704 may include similar cutouts to those shown in order to accommodate projections or other assemblies associated with the inside surface of vault door 112. Each model of automated teller machine 100 may be arranged slightly differently, resulting in different door armor panels 704 with different dimensions, cutouts, and projections. In some embodiments, door armor panel 704 may require multiple sections or may require standoffs similar to the top armor panel 1104 illustrated in FIG. 12B.

Referring now to FIG. 9B, a diagram illustrating an isometric view of a door armor panel 704 in accordance with embodiments of the present invention is shown. In the preferred embodiment, the door armor panel 704 is fabricated from 3/16 inch thick A36 steel plate. It may be preferable to use ¼ inch thick plate for the door armor panel 704, but in some automated teller machines 100 the increase thickness may prevent the vault door 112 from closing. It may also be preferable to utilize stainless steel for the door armor panel 704 since it may allow a thinner plate to be fabricated while still preserving strength.

Referring now to FIG. 10, a diagram illustrating an automated teller machine 100 with an extended console 1004 in accordance with embodiments of the present invention is shown. In most embodiments, rear areas of the console portion 104 of an automated teller machine 100 are required to be accessed in order to perform regular maintenance or repair components of the console portion 104. For example, console portion 104 may include a paper printer that may require paper or printing ink to be replenished. In some automated teller machines 100, the console portion 104 may be hinged in order to allow access to internal parts and components. In other automated teller machines 100, the console portion 104 may be mounted on rails or other means in order to allow the console portion 104 to be extended 1004, as shown in FIG. 10.

In addition to the door armor panel 704 and bottom armor panel 708, the present application includes a top armor panel 1104 described in more detail with respect to FIG. 11. In order to install or access the top armor panel 1104, the console portion 104 must be extended 1004 as shown in FIG. 10. View A-A illustrates the sightlines shown in FIG. 10.

Referring now to FIG. 11, a diagram illustrating a view A-A of an installed top armor panel 1104 in accordance with embodiments of the present invention is shown. The top armor panel 1104 protects access to the vault 304 through the top of the vault portion 108. In order to access the vault 304 through the top of the vault portion 108, in most cases the console portion 104 must either be removed, opened, or extended 1004 as shown.

Referring now to FIG. 12A, a diagram illustrating a plan view of a top armor panel 1104 in accordance with embodiments of the present invention is shown. Top armor panel 1104 is preferably fabricated from a single steel plate of uniform thickness, but in some embodiments may be constructed from multiple plates of varying dimensions, thicknesses, or materials. Top armor panel 1104 may include similar cutouts to those shown in order to accommodate projections or other assemblies associated with the top surface of vault portion 108. Each model of automated teller machine 100 may be arranged slightly differently, resulting in different top armor panels 1104 with different dimensions, cutouts, and projections. In some embodiments, top armor panel 1104 may not require standoffs similar to the top armor panel 1104 illustrated in FIG. 12B.

Referring now to FIG. 12B, a diagram illustrating an isometric view of a top armor panel 1104 in accordance with embodiments of the present invention is shown. In some embodiments, the top armor panel 1104 is secured with two threaded studs and a headless bolt. The threaded studs are spot welded in place, and extend downward to the top surface of the vault portion 108. Therefore, the threaded studs are not visible from the top when the console portion 108 is extended 1004. In some embodiments, holes may be drilled into the top of the vault portion 108 to accommodate the threaded studs. The top armor panel 1104 is preferably fabricated from ¼ inch-thick A36 plate steel. For most installations, a thicker top armor panel 1104 may be used as long as it does not interfere with extending or retracting the extended console 1004.

Referring now to FIG. 13, a diagram illustrating a view B-B of an installed bottom armor panel 708 in accordance with embodiments of the present invention is shown. The bottom armor panel 708 is shown in more detail with respect to FIGS. 14A and 14B. In order to install the bottom armor panel 708, the vault door 112 must be opened and the vault 304 removed. Bottom armor panel 708 includes at least a horizontal portion including mounting holes 428 to accommodate each required anchor bolt 1308. In the preferred embodiment, bottom armor panel 708 includes vertical sides 1312 around the edges of the horizontal portion, as shown. Advantageously, the vertical portions 1312 are welded together with the horizontal portion and provide additional stiffness to the entire bottom of the vault portion 108.

In the preferred embodiment, the bottom armor panel 708 includes a center hole corresponding to center hole 504 in the base panel 404 of the jacket 204. In one embodiment, the center hole of the bottom armor panel 708 is a similar diameter to each of the other holes corresponding to anchor bolts 1308A. However, in the preferred embodiment, the center hole 504 of the bottom armor panel 708 is a larger diameter (⅝", for example) to accommodate a larger anchor bolt 1308B than the other anchor bolts 1308A. A larger anchor bolt 1308B provides greater center anchoring strength for the entire automated teller machine 100, and in conjunction with a center hole washer 1304 may provide improved resistance to "smash and grab" attacks. In one embodiment, the center hole washer 1304 is a conventional steel washer appropriate to the size of the larger anchor bolt 1308B. In the preferred embodiment, the center hole washer 1304 is larger than the conventional round washer, in manufactured from similar material as any of the armor panels of the present application. In the preferred embodiment, the center hole washer 1304 is approximately 5 inches×5 inches and manufactured from ¼ or 3/16 inch thick armor panel material removed from the rear panel 408 to provide for the cable access openings 508. Many automated teller machines 100 do not provide a center hole 504 for an anchor bolt 1308A/B. In such cases, it is advantageous to drill a suitable mounting hole 504 in the bottom of the vault portion 108 and install a large anchor bolt 1308B in the floor below the automated teller machine 100. Preferably, the floor is concrete and provides good retention of all anchor bolts 1308A/B. In most cases, drilling a center mounting hole 504 and adding a large anchor bolt 1308B is the only modification required to either an automated teller machine 100 or underlying floor.

Referring now to FIG. 14A, a diagram illustrating a plan view of a bottom armor panel 708 in accordance with embodiments of the present invention is shown. The bottom armor panel 708 is sized to fit within the base of the vault portion 108 below the vault 304. The bottom armor panel 708 includes mounting holes 428, 504 as previously described, and may have a number of floor standoff mounting holes 1404. FIG. 14A shows four floor standoff mounting holes 1404, although any number (including zero) may be present. Floor standoff mounting holes 1404 provide clearance for nuts welded to the base of the automated teller machine 100 in order to provide a limited amount of standoff from the floor. In some installations, the floor may not be completely level, and leveling feet may allow adjustment so that the automated teller machine 100 may be oriented in an upright and stable position. In some embodiments, especially where leveling feet are not desired or required, floor standoff mounting holes 1404 may not be present.

In the preferred embodiment, bottom armor panel 708 includes one or more stiffening ribs 1408. In the embodiment illustrated four stiffening ribs 1408 are shown, although in practice any number and arrangement of stiffening ribs 1408 may be present. Stiffening ribs 1408 provide additional rigidity to the horizontal section of the bottom armor panel 708, and resist flexing. In one embodiment, stiffening ribs 1408 are welded ribs made of similar material as the bottom armor panel 708. In another embodiment, stiffening ribs 1408 are welded ribs made of a different material as the bottom armor panel 708. In another embodiment, stiffening ribs 1408 are riveted or otherwise fastened to the bottom armor panel 708. In yet another embodiment, stiffening ribs 1408 provide strength in multiple directions, or are installed diagonally on the bottom armor panel 708. In yet another embodiment, stiffening ribs 1408 are arranged irregularly, with variable spacing, or randomly. In yet another embodiment, stiffening ribs 1408 are provided on the top side or both sides of the bottom armor panel 708.

Referring now to FIG. 14B, a diagram illustrating an isometric view of a bottom armor panel 708 in accordance with embodiments of the present invention is shown. FIG. 14B illustrates the various features of the bottom armor panel 708, including common hole 428, 504 locations. The combination of the vertical sides 1312, stiffening ribs 1408, center hole 504, larger anchor bolt 1308B, and center hole washer 1304 of the preferred embodiment lend great strength to the bottom armor panel 708 to resist most forms of expected automated teller machine 100 attacks. The bottom armor panel 708 is preferably fabricated from 14 gauge A36 steel plate.

The various views and illustration of automated teller machine 100 security-related components provided in the Figures are representative of exemplary systems, environments, and methodologies for performing novel aspects of the disclosure. For example, those skilled in the art will understand and appreciate that a component could alternatively be represented as a group of interrelated sub-components attached through various temporarily or permanently configured means. Moreover, not all components illustrated herein may be required for a novel embodiment, in some components illustrated may be present while others are not.

The descriptions and Figures included herein depict specific embodiments to teach those skilled in the art how to make and use the best option. For the purpose of teaching inventive principles, some conventional aspects have been simplified or omitted. Those skilled in the art will appreciate variations from these embodiments that fall within the scope of the invention. Those skilled in the art will also appreciate that the features described above can be combined in various ways to form multiple embodiments. As a result, the invention is not limited to the specific embodiments described above, but only by the claims and their equivalents.

Finally, those skilled in the art should appreciate that they can readily use the disclosed conception and specific embodiments as a basis for designing or modifying other structures for carrying out the same purposes of the present invention without departing from the spirit and scope of the invention as defined by the appended claims.

I claim:

1. A system, comprising:

a jacket comprising a plurality of armor panels, comprising:

a base panel of rectangular disposition, comprising first and second opposed sides, a back side, and a first plurality of holes configured to allow an automated teller machine comprising a vault to be secured to a floor by anchor bolts secured to the floor through the first plurality of holes;

a rear panel, extending upwards from the base panel, comprising first and second opposed vertical sides and a bottom side, the rear panel bottom side orthogonally secured to the back side of the base panel;

a first side panel, extending upwards from the base panel a predetermined distance, comprising:

a bottom edge orthogonally secured to the first side of the base panel;

a rear edge orthogonally secured to the first vertical side of the rear panel; and a front edge that, when the jacket is installed to the automated teller machine, is adjacent to one or more vault door hinges of a vault door of the automated teller machine and configured to allow the vault door to swing between open and closed positions, the vault door configured to be in the closed position when locked and the open position when the vault is being accessed;

a second side panel, extending upwards from the base panel the predetermined distance, comprising:

a bottom edge orthogonally secured to the second side of the base panel;

a rear edge orthogonally secured to the second vertical side of the rear panel; and a front edge that, when the jacket is installed to the automated teller machine, is adjacent to an opening side of the vault door and configured to vertically cover a seam between the vault door and a chassis of the automated teller machine when the vault door is closed; and no top panel affixed to any of the base panel, the rear panel, and first and second side panels.

2. The system of claim 1, further comprising:

a door armor panel, configured to be fastened to an interior surface of the vault door and prevent access to a front of the vault when the vault door is closed, the door armor panel not externally visible when the vault door is closed.

3. The system of claim 1, further comprising:

a top armor panel, configured to be fastened above a top surface of the vault and prevent access to a top of the vault, the top armor panel not externally visible when a console portion of the automated teller machine is closed.

4. The system of claim 1, further comprising:

a bottom armor panel, configured to be fastened to an interior bottom surface of the automated teller machine below the vault, comprising a second plurality of holes matching the first plurality of holes in the base panel, wherein fastening hardware secures the bottom armor panel, bottom surface of the automated teller machine, and base panel to anchor bolts embedded in the floor, wherein the bottom armor panel is not externally visible when the vault door is closed.

5. The system of claim 4, wherein the second plurality of holes comprises a center hole generally positioned at the center of the bottom surface of the automated teller machine, the center hole of larger diameter to accommodate a larger anchor bolt than the other holes of the second plurality of holes.

6. The system of claim 5, further comprising:

a center hole washer, configured to be installed over the larger anchor bolt between the bottom armor panel and a nut, wherein the center hole washer distributes forces over larger areas of the bottom armor panel than washers or nuts associated with the other holes of the second plurality of holes, wherein the center hole washer is fabricated from a same material as at least one of the jacket, the top armor panel, the door armor panel, or the bottom armor panel.

7. The system of claim 4, wherein the bottom armor panel comprises a plurality of stiffening ribs welded to at least one side of the bottom armor panel.

8. The system of claim 1, wherein the jacket weighs 150 lbs or less, wherein the jacket comprises a fabricated armor plate with orthogonal bends between the plurality of armor panels.

9. The system of claim 1, wherein the jacket weighs 150 lbs or less, wherein each armor panel of the plurality of armor panels is separately fabricated and welded along seams where the plurality of armor panels are orthogonally secured.

10. The system of claim 9, wherein the first and second side panels being a first predetermined thickness and the rear and base panels being a second predetermined thickness less than the first predetermined thickness.

11. A system, comprising:

an automated teller machine, comprising:

a console portion, disposed within a top portion of the automated teller machine; and a vault portion, disposed within a bottom portion of the automated teller machine, comprising:

a vault, configured to store cash, comprising:

a vault door, disposed on a front surface of the vault and configured to be in a closed position when locked and an open position when the vault is being accessed; and one or more vault door hinges disposed between a front side of the vault and a side of the vault door, configured to allow the vault door to swing between the open and closed positions; and a jacket comprising a plurality of armor panels, configured to cover bottom, side, and rear surfaces of the vault portion, the jacket comprising:

a base panel of rectangular disposition, comprising first and second opposed sides, a back side, and a first plurality of holes through which anchor bolts secure the automated teller machine to a floor beneath the jacket, the anchor bolts and associated washers and nuts providing the only fastening devices between the jacket and the automated teller machine;

a rear panel, extending upwards from the base panel a predetermined distance, comprising first and second opposed vertical sides and a bottom side, the rear panel bottom side orthogonally secured to the back side of the base panel, the predetermined distance extending to a height greater than a top level of the vault;

a first side panel, extending upwards from the base panel the predetermined distance, comprising:

a bottom edge orthogonally secured to the first side of the base panel;

a rear edge orthogonally secured to the first vertical side of the rear panel; and a front edge adjacent to the one or more vault door hinges and configured to allow the vault door to swing between open and closed positions, the vault door configured to be in the closed position when locked and the open position when the vault is being accessed;

a second side panel, extending upwards from the base panel the predetermined distance, comprising:

a bottom edge orthogonally secured to the second side of the base panel;

a rear edge orthogonally secured to the second vertical side of the rear panel; and a front edge that, when the jacket is installed to the automated teller machine, is adjacent to an opening side of the vault door and configured to cover a vertical seam between the vault door and a chassis of the automated teller machine when the vault door is closed; and no top panel affixed to any of the base panel, the rear panel, and first and second side panels.

12. The system of claim 11, wherein the jacket weighs 150 lbs or less, wherein the jacket comprises a fabricated armor plate with orthogonal bends between the plurality of armor panels.

13. The system of claim 11, wherein the jacket weighs 150 lbs or less, wherein each armor panel of the plurality of armor panels is separately fabricated and welded along seams where the plurality of armor panels are orthogonally secured.

14. The system of claim 13, wherein the first and second side panels being a first predetermined thickness and the rear and base panels being a second predetermined thickness less than the first predetermined thickness.

15. The system of claim 11, further comprising:

a door armor panel, configured to be fastened to an interior surface of the vault door and protect a front of the vault when the vault door is closed, the door armor panel not externally visible when the vault portion is closed.

16. The system of claim 11, further comprising:

a top armor panel, configured to be fastened above a top surface of the vault portion and prevent access to a top of the vault, the top armor panel not externally visible when the console portion is closed.

17. The system of claim 11, further comprising:

a bottom armor panel, configured to be fastened to an interior bottom surface of the vault portion below the vault, comprising a second plurality of holes matching the first plurality of holes in the base panel, wherein fastening hardware secures the bottom armor panel, bottom surface of the automated teller machine, and base panel to anchor bolts embedded in the floor, wherein the bottom armor panel is not externally visible when the vault portion is closed.

18. The system of claim 17, wherein the second plurality of holes comprises a center hole generally positioned at the center of the bottom surface of the automated teller machine, the center hole of larger diameter to accommodate a larger anchor bolt than the other holes of the second plurality of holes.

19. The system of claim 18, further comprising:

a center hole washer, configured to be installed over the larger anchor bolt between the bottom armor panel and a nut, wherein the center hole washer distributes forces over larger areas of the bottom armor panel than washers or nuts associated with the other holes of the second plurality of holes, wherein the center hole washer is fabricated from a same material as at least one of the jacket, the top armor panel, the door armor panel, or the bottom armor panel.

20. The system of claim 17, wherein the bottom armor panel comprises a plurality of evenly spaced parallel stiffening ribs welded to at least one side of the bottom armor panel.

* * * * *